US005952099A

United States Patent [19]

Asher et al.

[11] Patent Number: 5,952,099

[45] **Date of Patent: *Sep. 14, 1999**

[54] PROCESS FOR MAKING ELECTRICALLY CONDUCTIVE FIBERS

[75] Inventors: Pravin P. Asher, Candler; Robert L. Lilly; Grover L. Davenport, Jr., both of Asheville; Robert K. Hyatt, Canton; Charles H. Rogers, Asheville, all of N.C.

[73] Assignee: BASF Corporation, Mt. Olive, N.J.

[ * ] Notice: This patent is subject to a terminal disclaimer.

[21] Appl. No.: 09/009,064

[22] Filed: Jan. 20, 1998

Related U.S. Application Data

[60] Continuation of application No. 08/870,741, Jun. 6, 1997, Pat. No. 5,776,608, which is a division of application No. 08/686,854, Jul. 26, 1996, Pat. No. 5,698,148.

[51] Int. Cl.[6] ..... D02G 3/00

[52] U.S. Cl. ..... 428/370; 428/373; 428/374

[58] Field of Search ..... 428/370, 374, 428/373

[56] References Cited

U.S. PATENT DOCUMENTS

| | | | |
|---|---|---|---|
| 3,558,419 | 1/1971 | Okazaki et al. | 428/374 |
| 3,803,453 | 4/1974 | Hull | 264/105 X |
| 3,969,559 | 7/1976 | Boe | 428/87 |
| 4,085,182 | 4/1978 | Kato | 428/397 |
| 4,129,677 | 12/1978 | Boe | 428/372 |
| 4,216,264 | 8/1980 | Naruse et al. | 428/397 |
| 4,242,382 | 12/1980 | Ellis et al. | 427/379 |
| 4,388,370 | 6/1983 | Ellis et al. | 428/368 |
| 4,406,850 | 9/1983 | Hills | 264/169 |
| 4,420,534 | 12/1983 | Matsui et al. | 428/372 |
| 4,610,925 | 9/1986 | Bond | 428/368 |
| 4,756,969 | 7/1988 | Takeda | 428/372 |
| 5,162,074 | 11/1992 | Hills | 216/83 |
| 5,698,148 | 12/1997 | Asher et al. | 264/105 |
| 5,776,608 | 7/1998 | Asher et al. | 428/373 |

FOREIGN PATENT DOCUMENTS

| | | | |
|---|---|---|---|
| 59-223313 | 12/1984 | Japan | 264/105 |

OTHER PUBLICATIONS

Rolfe, Sue: Epitropic: ICI's Surface Modified Antistatic Fibre, *Fibre Technology, Textile Month*, Aug. 1993, pp. 40–41.

Japan Textile News, *Hi–Tech Textile 1987*, Osaka Senken Ltd.: Osaka, Japan, 1987, pp. 143–181.

*Primary Examiner*—Newton Edwards

[57] ABSTRACT

Electrically conductive thermoplastic fibers are made by spinning a fiber having an electrically conductive sheath of thermoplastic polymer formulated with carbon black and a non-conductive core from the thermoplastic polymer; quenching the fiber after said spinning to a temperature below the melting point of the thermoplastic; drawing the quenched fiber at a draw ratio between about 2.0 and about 3.2; and, after drawing, relaxing the fiber at a temperature below the melting point of the thermoplastic but above its glass transition.

7 Claims, No Drawings

PROCESS FOR MAKING ELECTRICALLY CONDUCTIVE FIBERS

This application is a continuation of U.S. patent application Ser. No. 08/870,741, filed Jun. 6, 1997, now U.S. Pat. No. 5,776,608; which is a divisional of U.S. patent application Ser. No. 08/686,854 filed Jul. 26, 1996, now U.S. Pat. No. 5,698,148.

FIELD OF THE INVENTION

The present invention relates generally to electrically conductive fibers and for processes to make them. More particularly, the present invention relates to drawn sheath-core electrically conductive fibers and processes for making them.

BACKGROUND OF THE INVENTION

In this description of the invention, certain terms have the meanings ascribed to them. "Fiber" or "fibers" refers to either staple length fibers or continuous filaments. "Bicomponent" refers to a fiber cross-section where two different polymers are disposed in a longitudinally coextensive relationship. e.g., sheath-core, side-by-side, islands-in-sea. "Conductivity" refers to the characteristic exhibited by staple fibers and continuous filaments which dissipate electrostatic charges. For the purposes of the present discussion, resistives up to $10^{10}$ ohms/cm and preferably $10^8$–$10^9$ ohms/cm are considered indicative of conductive fibers.

It is known that friction generates static electricity in synthetic fibers, such as polyamide fibers, polyester fibers, acrylic fibers, etc., and also in some natural fibers like wool. This is a disadvantage of synthetic fibers, especially when such fibers are used in applications where the discharge of static electricity (the characteristic shock) can have serious consequences. For example, the discharge of static electricity can damage computers and other electronic equipment. In some cases, such as in flammable atmospheres, the discharge of static electricity can result in a fire or explosion.

Because of the propensity of certain fibers to generate (or not dissipate) an electrical charge and because fibers are prevalent in many environments where static electricity is undesirable (carpet in computer rooms, clean room garments, etc.) a large number of proposals to address the generation of static electricity have arisen. In general, these methods concern either imparting conductivity to the fibers themselves or to the article made from the fibers by incorporating one or more individually conductive fibers in the article or treating the fibers or article made from fibers with an antistatic surface treatment. Surface treatments are not generally desirable.

The invention concerns conductive fibers for incorporation into fibrous articles like carpet or textiles. One of the proposals is to mix electrically conductive carbon back in the synthetic fibers. There exist a variety of fiber cross-sections where a portion of the cross-section contains carbon black (or some other conductive material like metal).

One cross-section involves penetrating carbon black or metal particles into the periphery of a synthetic fiber. This method has the disadvantage of being labor intensive and also requiring specialized equipment for handling the fiber during the penetration step. The fibers made by this method sometimes flake off the conductive layer adhered to the surface, requiring special handling to ensure that this does not happen.

U.S. Pat. No. 4,388,370 to Ellis et al. describes a drawn melt spun sheath-core bicomponent fiber where carbon black is penetrated into the periphery of the fiber. The sheath has a lower melting point than the core to facilitate the penetration of the carbon black (or finely divided metal).

U.S. Pat. No. 4,242,382 to Ellis et al. describes another process for adhering electrically conductive particles to the surface of a fiber. An article entitled *Epitropic; ICI's Surface Modified Antistatic Fibre, Fibre Technology, Textile Month,* August, 1993, pp. 40–41, describes a polyester bicomponent fiber with electrically conductive particles adhered to the surface.

Sheath-core bicomponent fibers with conductive sheaths have been made also by co-spinning the conductive composition with the non-conductive composition in an arrangement where the conductive composition forms a sheath around a core of the non-conductive composition. Such a bicomponent fiber for brush applications is described in U.S. Pat. No. 4,610,925 to Bond. Being designed for use in hairbrushes, the Bond fiber is very large (a diameter of at least 0.25 mm). Because the sheath and core are made of different polymers, this type of fiber also may tend to flake or defibrillate at the sheath-core interface.

Another cross-section is made by co-spinning a nonconductive material with a conductive material in a predetermined relationship to achieve a conductive core/non-conductive sheath relationship. Such a fiber is disclosed in U.S. Pat. No. 3,803,453 to Hull. The Hull fiber preferably is a bicomponent fiber. Hull acknowledges the relatively fragile nature of these fibers by teaching to exercise care in the drawing of them, e.g., avoiding sharp corners.

U.S. Pat. No. 4,085,182 to Kato describes a conductive core sheath-core bicomponent electrically conductive synthetic fiber made by simultaneously melt spinning the conductive and non-conductive compositions in a sheath-core arrangement and taking up the fibers at least 2,500 meters per minute. The "high speed" take-up is taught to make a drawing step unnecessary. The resistance of the Kato fiber is on the order of $10^8$ to $10^9$ ohms/cm.

However, fibers where the non-conductive portion completely covers the conductive portion suffer from generally decreased conductivity. One method of addressing the problem of decreased conductivity in a conductive core arrangement is to arrange the conductive materials and non-conductive materials in a fashion where the conductive material is partly exposed to the surface, for example, by offsetting the core. U.S. Pat. No. 4,216,264 to Naruse et al. describes a fiber having a carbon black containing electrically conductive section radiating from the core of the fiber and extending in at least two directions. The resistance of the fibers was less than $1\times10^{13}$ ohm/cm (no less than $1.4\times10^8$ per filament. The conductive sections and non-conductive sections are preferably made of the same polymer.

U.S. Pat. No. 4,756,969 to Takeda describes a fiber of a modified sheath-core type where the sheath includes layers of nonconductive material and electrically conductive material. The electrically conductive material is exposed at a fraction of the fiber's periphery.

U.S. Pat. No. 4,420,534 to Matsui et al. describes a bicomponent fiber having generally internal layers of conductive material. The fiber is made from two polymers differing in melting point by at least 30 degrees. Matsui recognizes the problem of lost conductivity caused by drawing fibers and proposes several methods to address the problem. One of these methods involves relaxing the drawn fiber at a temperature above the melting or softening point of the lower melting polymer but below the melting or softening point of the other polymer. The specific resistance of the Matsui fiber is $3.5\times10^3$ ohms/cm or higher.

U.S. Pat. No. 4,129,677 to Boe describes a side-by-side bicomponent fiber where the conductive portion occupies a portion of the periphery of the fiber. The resistance of the Boe fibers is $1.89\times10^8$ ohms/cm or higher.

U.S. Pat. No. 3,969,559 to Boe describes a side-by-side bicomponent fiber where the nonconductive constituent partially encapsulates the conductive constituent.

Controlling the degree that the conductive component is exposed to the fiber surface is difficult in production. For example, the conductive component might become excessively covered with the non-conductive component (sometimes the non-conductive component completely covers the conductive component) and the conductivity of the fiber consequently lowers. Also, the use of electrically conductive materials is known to affect the properties of the fibers, for example, the spinnability, strength and elongation are typically decreased. It remains a goal of the efforts to address static electricity in fibers by making an electrically conductive fiber to dissipate static and yet to process like and have the properties of regular (non-conductive) synthetic fibers.

SUMMARY OF THE INVENTION

In the present invention, as-spun (undrawn) feeder yarns are drawn to obtain desirable elongation, tenacity and shrinkage by a two-step process. During normal drawing (without relaxation) using conventional drawing equipment, the electric resistance of the yarn changed from $10^8$ ohms/cm to greater than $10^9$ ohms/cm. With the present invention, the electrical resistance of drawn yarn improved to less than $10^9$ ohms/cm using a post-drawing relaxation step. The yarns thus have excellent electrical and physical properties and are acceptable for warping, weaving, knitting, staple and carpet end uses.

It is an object of the present invention to provide synthetic fibers which have excellent electrical conductivity and which process like non-conductive fibers of the same type.

A further object of the present invention is to provide a process for making electrically conductive fibers reproducible on a commercial scale.

Related objects and advantages of the invention will become apparent to those of ordinary skill in the art from the following description.

DETAILED DESCRIPTION OF THE PREFERRED EMBODIMENTS

To promote an understanding of the principles of the present invention, descriptions of specific embodiments of the invention follow and specific language is used to describe them. It will nevertheless be understood that no limitation of the scope of the invention is intended by the use of specific language. Alterations, further modifications and such further applications of the principles of the invention discussed are contemplated as would normally occur to one ordinarily skilled in the art to which the invention pertains.

One embodiment of the present invention is a process for making drawn electrically conductive fibers with excellent conductivity. It has been discovered that the conductivity of drawn fibers lost by drawing can be restored by relaxing the fibers after drawing. The details of the process steps are described below. The process is preferably carried out on fibers having the composition described later in this specification, but it is believed that the process is not limited to the fibers so described.

In the present invention, a portion of synthetic thermoplastic polymer is formulated with carbon black (or another electrically conductive material. This becomes the electrically conductive portion. Another portion is not formulated with a conductive material. This becomes the non-conductive material. Conventional additives (e.g., delusterants, flame retardants, etc.) may also be present in either the conductive or non-conductive portion.

The conductive composite fibers of the present invention can be produced by a spin pack designed for spinning multicomponent fibers. One such spinning apparatus and method is disclosed in U.S. Pat. No. 5,162,074. As those of ordinary skill in the art will recognize, the spinning conditions will take the polymer being spun into account. In one suitable spin pack, the conductive portion is arranged to form a sheath around a core of the non-conductive portion. After spinning, the molten fibers are quenched and finished according to conventional art. The conductive portion and non-conductive portion may be arranged in various relationships other than conductive sheath around a non-conductive core. For example, side-by-side fibers may be made or the sheath portion may be non-conductive, etc.

The process of the present invention is preferably a "two-step" process where the drawn fiber is taken up before drawing. The preferable take-up speed is between about 600 and 2500 m/min. Following take-up, the fiber is drawn, followed by relaxation.

The spun undrawn composite fibers are drawn by the conventional process at room temperature or with added heating. When heated drawing is desired, a heated godet, pin, etc., may be used. The temperature for drawing will vary depending upon the synthetic polymer used. For both polyester, like poly(ethylene terephthalate) or other polyesters and nylon, like nylon 6 or others nylons, the preferred drawing temperature is between about 80° C. and about 150° C. and the draw ratio is greater than about 2.0 and less than about 3.2.

Following drawing, the fiber is relaxed. Relaxation takes place at temperature above the glass transition temperature (Tg) of the synthetic polymer but below its melting or softening temperature. For both poly(ethylene terephthalate) and polycaprolactam, the preferred relaxation temperature is between about 80° C. and about 150° C. The relaxation takes place either with added heat or with residual heat from the drawing step. When added heat is used, it may be supplied by heated godet or hot plate. Relaxation is preferably initiated by overfeed of the drawn fiber in the wind up step. Preferably, the overfeed will be greater than about 2.0% and less than about 7.0%.

Another embodiment of the present invention is a conductive fiber having an electrical resistance of less than $1\times10^{13}$ ohms/cm and composed of synthetic thermoplastic fiber-forming polymer containing carbon black and a non-conductive component composed of the same synthetic thermoplastic fiber-forming polymer. The conductive portions and non-conductive portions are continuously bonded in the longitudinal direction with the conductive portion forming a sheath around a core of the non-conductive portion. The conductive portion does not exceed about 40% of the cross-sectional area of the fiber.

The preferable cross-section of the fiber made according to the present invention is such that the conductive portions forms a periphery around the non-conductive portion, much like a sheath around a core. For the purposes of this disclosure, the conductive portion will be referred to as forming a sheath even though the fiber is not a bicomponent fiber.

The cross-sectional area of the conductive sheath preferably is about 15 to about 40% of the total fiber cross-section and, more preferably, about 20 to about 30%. It is desirable, but not essential that the thickness of the conductive sheath portion is substantially uniform around the non-conductive core.

The conductive portion is of synthetic thermoplastic fiber-forming polymer formulated with conductive carbon black.

The non-conductive portion is composed of the same synthetic thermoplastic fiber-forming polymer as the conductive portion.

Useful synthetic thermoplastic fiber-forming polymers include polyamides, polyesters, polyvinyls, polyolefins, acrylic polymers, polyurethane and the like. Useful polyamides, for example, include polycaprolactam, poly (hexamethyleneadipamide), nylon-4, nylon-7, nylon-11, nylon-12, nylon-6,10, poly-m-xylyleneadipamide, poly-p-xylyleneadipamide and the like. Useful polyesters include, for example, poly(ethylene terephthalate), poly (tetramethylene terephthalate), poly(ethylene oxybenzoate), 1,4-dimethylcyclohexane terephthalate, polypivalolactone and the like. Useful polyvinyls include, for example, polyvinyl chloride, polyvinylidene chloride, polyvinyl alcohol, polystyrene and the like. Useful polyolefins include, for example, polyethylene, polypropylene and the like. Useful acrylic polymers include, for example, polyacrylonitrile, polymethacrylate and the like. Of course. copolymers consisting of the respective monomers of the above described polymers and other known monomers also can be used. Among the synthetic thermoplastic fiber-forming polymers, polyamides, polyesters and polyolefins and the like are preferable. Most preferably, the synthetic thermoplastic polymer is poly(ethylene terephthalate).

Because the conductive and non-conductive portions are composed of the same synthetic polymer, the difficulties within compatibility of components, fibrillation of the conductive sheath, etc., are not experienced with the present invention.

The conductive portion is formulated to contain at least three ingredients. These are the synthetic polymer, the carbon black and a compatibilizer for compatibilizing the carbon black in the synthetic polymer. The amount of carbon black used to create a particular level of resistance depends on the kind of carbon black to be used but, generally is preferably 3–40% by weight based on the weight of the conductive portion, more preferably, 5–35% by weight, and most preferably 10–35% by weight.

The conductive carbon black may be dispersed in the polymer by well known mixing processes.

Preferably, for uniformity of carbon black particles in polymer and ease in compounding, wetting agents and compatibilizers may be used. A presently preferred form of the invention uses poly(butylene terephthalate) as a compatibilizer for carbon black in poly(ethylene terephthalate) materials.

The fibers of the present invention exhibit electrical resistance in the longitudinal direction (in response to a direct current of 1,000 volts) applied of less than $1\times10^{13}$ ohms/cm, preferably less than $1\times10^{11}$ ohms/cm, more preferably less than $1\times10^{9}$ ohms/cm.

The cross-sectional shape of the composite fibers according to the present invention may be circular or non-circular. Preferably, the denier per filament is less than about 15 and, most preferably, about 2 to about 5. Also, contemplated is the reverse arrangement where the conductive portion forms the core. This configuration is desirable when the black of the carbon must be masked. A gray fiber can be produced by using $TiO_2$ in the non-conductive sheath.

The composite fibers according to the present invention can be used in the form of filament or as staple fibers and can be formed into fibrous structures, such as, knitted fabrics, woven fabrics, non-woven fabrics, carpets and the like by blending other fibers.

When the composite fibers according to the present invention are blended with other fibers, the blend ratio may be optionally selected depending upon the target conductivity or result. In order obtain the antistatic fibrous structures, it is merely necessary that the composite fibers according to the present invention are blended in the ratio of about 5 to about 25% by weight, preferably about 5 to about 15%. In general, the larger the blend ratio, the stronger the antistatic property is. As the blending processes, all well known processes, for example, fiber mixing, mix spinning, doubling, doubling and twisting end unioning, may be used. Thus, by blending a very small amount of the fibers according to the present invention to the other fibers, for example, usual synthetic fibers, the fibrous products may be made to be antistatic or even conductive, depending on the blending ratio.

The following examples are given for the purpose of illustration of this invention and are not intended as limitations thereof. In the examples, "%" means percent by weight unless otherwise indicated.

The following test methods were used in the examples:

Electrical Properties:

Resistivity is measured according to AATCC Test Method 84–89 "Electrical Resistivity of yarns" except that 3 specimens per sample are used and no radioactive bar is used to remove static charges prior to testing. The samples are charged for 30 seconds at 1,000 volts unless no reading is obtained after this charging. In that case, the voltage is dropped to 500 and continues dropping by increments of 10 volts until a reading can be made. The results are reported as ohms/cm.

Tensile Properties:

Tensile properties are measured according to ASTM Method D2256-90 "Standard Test Method for Tensile Properties of yarns by the Single-Strand Method."

Boiling Water Shrinkage:

Boiling water shrinkage is measured by ASTM method D2259-91 "Standard Test Method for Shrinkage of yarns" except that the skein length is 90 meters for yarns up to 100 denier and varies for larger denier yams according to the formula "skein length=9,000/denier". Prior to testing, the skeins are conditioned for at least one hour at conditions (65% RH and 70±2° F.).

EXAMPLE 1

Three (3) denier per filament (dpf) melt spun, fully drawn carbon sheath polyester filament is prepared using a pilot scale made having 16 spinning positions; 25 mm/24D extruder and a capacity of 120 grams/minute. A separate extruder feeds a carbon-laden polyester sheath stream to each spin block. Thin plates are used to form the sheath/core fiber structure immediately above the spinneret backholes.

Feeder yarns are melt-extruded from the spinneret in a sheath/core arrangement. The fiber consists of a polyester sheath containing conductive carbon black pigment (Cabot® XC-72) dispersed in the polymer supplied in polyester chip concentrate form. The carbon black is dispersed with poly(butylene terephthalate) chip concentrates supplied by Polymer Color Inc. of McHenry, Ill. Alternatively, the carbon black is dispersed in chip concentrates supplied by Alloy Polymers. The concentration of carbon black in the chip concentrates ranged from 10–25% by weight. The core is a clear PET core. The polymer ratio of conductive and non-conductive polymers in the yarns ranged from 10:90 to 30:70. The extruded fibers were taken up at speeds between 600 and 1200 m/min. The yarns are subsequently drawn at temperatures between 80° C. and 150° C. using either hot godets or a hot plate on conventional drawing equipment and relaxed with residual heat. The detailed experimental conditions for all samples are shown in Table 1.

Tables 2 and 3 show yarn properties for the various spinning and drawing conditions.

TABLE 1

| Process Conditions | | |
|---|---|---|
| Raw Materials | | |
| Polymer type (25-mm extruder) | Clear polyester | |
| Polymer type (18-mm extruder) | Carbon black in polyester or carbon black in PET/PBT blend | |
| Spin pack type | Conductive-sheath | |
| Spinning | Core Extruder | Sheath Extruder |
| Zone 1 temperature, ° C. (range) | 270 | 260 |
| Zone 2 temperature, ° C. | 280 | 291 |
| Zone 3 temperature, ° C. | 294 | 291 |
| Die Head temperature, ° C. | 294 | |
| ISG temperature, ° C. | 294 | |
| Spin Beam temperature, ° C. | 297 | |

TABLE 1-continued

| Process Conditions | |
|---|---|
| Winding | |
| Winder type | Toray TW-336 |
| Spin finish roll speed, rpm | 5 |
| First godet speed, m/min | 1200 |
| Second godet speed, m/min | 1200 |
| Friction roll speed, m/min | 1192 |
| Winding tension, g | 3–6 |
| Drawtwisting | |
| Drawtwister type | Barmag SZ-16; A-4 |
| Draw ratio | 2.5 |
| Overfeed, % | 4 |
| Drawing speed, m/min | 400 |
| Hot godet temperature, ° C. | 120 |
| Hot plate temperature, ° C. | 150 |
| Yarn Data | |
| Denier | 20.7 |
| Elongation, % | 48.5 |
| Tenacity, g/d | 3.75 |
| Boiling water shrinkage, % | 5.2 |
| Electric resisitivity, ohms/cm | $4.3 \times 10^7$ |

TABLE 2

600 M/Min Winding Speed For Different Sheath/Core Ratios And Carbon Concentrations

| | | Yarn Properties (Undrawn) | | | |
|---|---|---|---|---|---|
| Sheath/Core Ratio (%) | Carbon Conc. (%) | Denier | Tenacity (g/den) | Elongation (%) | Electrical Resistivity (ohms/cm) |
| Control* | 0 | 64.5 | 1.04 | 373.7 | $5.7 \times 10^{15}$ |
| 15/85 | 10.0 | 64.8 | 1.01 | 390.1 | $2.1 \times 10^{10}$ |
| 20/80 | 10.0 | 64.2 | 1.06 | 406.9 | $2.0 \times 10^{10}$ |
| 20/80 | 15.0 | 65.1 | 1.01 | 395.8 | $2.1 \times 10^9$ |
| 20/80 | 20.0 | 64.2 | 1.02 | 387.0 | $5.7 \times 10^8$ |
| 20/80 | 22.5 | 63.9 | 0.89 | 364.3 | $3.2 \times 10^8$ |
| 20/80 | 22.5 | (22.3) | (2.53) | (46.8) | $(3.9 \times 10^9)$ |
| 20/80 | 25.0 | 63.2 | 0.98 | 381.8 | $3.0 \times 10^6$ |
| 30/70 | 22.5 | 63.4 | 0.76 | 334.8 | $1.1 \times 10^6$ |

*Control made with PET in both sheath and core.

( ) denotes yarn drawn on drawtwister at draw ratio of 3.0 at 400 m/min, 120° C. hot godet temperature and 150° C. hot plate temperature.

TABLE 3

| | Carbon | Winding | Undrawn Yarn Properties | | | |
|---|---|---|---|---|---|---|
| Carbon Conc. | Sheath (%) | Speed (m/min) | Denier | Tenacity (g/den) | Elongation (%) | Resistivity (ohms/cm) |
| Without PBT | 25 | 1000 | 64.1 (22.5) | 1.14 (2.69) | 317.6 (36.2) | $5.5 \times 10^6$ $(3.3 \times 10^9)$ |
| Without PBT | | 1200 | 53.9 (22.5) | 1.15 (2.77) | 285.2 (37.9) | $3.9 \times 10^8$ $(1.1 \times 10^9)$ |
| With PBT | 25 | 1000 | 51.9 (21.2) | 1.54 (3.22) | 364.9 (42.0) | $5.7 \times 10^6$ $(7.2 \times 10^8)$ |
| With PBT | | 1200 | 49.5 (21.5) | 1.44 (3.49) | 314.0 (57.7) | $1.1 \times 10^6$ $(2.3 \times 10^7)$ |

( ) denotes drawn yarn properties on drawtwister at 2.5 draw ratio, 120° C. hot godet, 150° C. hot plate and 4% overfeed in second stage.

EXAMPLE 2

9.3 denier per filament (dpf) melt spun, undrawn carbon sheath PET filament is prepared using a commercial scale 96 spinning position machine. A separate extruder feeds carbon-laden polyester sheath stream to each spin block. Thin plates are used to form the sheath/core fiber structure immediately above the spinneret backholes.

Feeder yams are melt-extruded from the spinneret in a sheath/core, arrangement. The fiber consists of a polyester sheath containing conductive carbon black pigment (Cabot® XC-72) dispersed in the polymer supplied in polyester chip concentrate form and a clear PET core. The extruded fibers were taken up at 800 m/min. The yarns are subsequently drawn with heat using a hot plate at 140° C. on conventional drawing equipment and relaxed with residual heat. The processing conditions from Example 1 are used to make the feeder yarns. The feeder yarns are drawn on a three-stage Zinser® draw-winder. Drawing conditions and yarn properties are shown in Table 4.

TABLE 4

| Machine Settings | |
|---|---|
| Drawing Speed | 800 m/min |
| Take-up Overfeed | 1.0251 |
| Draw ratio zone 1 | 1.008 |
| Draw ratio zone 2 | 2.800 |
| Shrinkage | 1.000 |
| Traverse | 0328 |
| Draw roll no. 1 temperature | 85° C. |
| Hot plate temperature | 140° C. |
| Draw roll no. 2 temperature | 140° C. |
| Draw roll no. 3 temperature | Ambient |
| Interlacing air pressure | 2 bar |
| Yarn take-up tension | 1.4 to 2.2 grams |
| Yarn Data | |
| Denier | 20 |
| Elongation | 25–45% |
| Tenacity | 2.5–3.5 g/den |
| Boiling water shrinkage | 6.0% |
| Melting point | 250° C. |
| Electric resistivity | $10^7$–$10^9$ ohms/cm |

What is claimed is:

1. An electrically conductive melt-spun fiber having a denier per filament of about 3 to about 10 and a transverse cross-section with an electrically non-conductive core formed from a synthetic thermoplastic fiber-forming host polymer; and an electrically conductive sheath consisting essentially of said synthetic thermoplastic fiber-forming host polymer formulated with electrically conductive carbon black uniformly dispersed therein from about 3 to about 40% by weight and a compatibilizer; said fiber having an electrical resistance of less than $1\times10^{13}$ ohms/cm.

2. The composite fiber of claim 1 wherein the electrical resistance of said fiber is less than $1\times10^{11}$ ohms/cm.

3. The composite fiber of claim 1 wherein said synthetic thermoplastic fiber-forming host polymer is at least one polymer selected from the group consisting of:

polyamides;

polyesters;

polyvinyls;

polyolefins;

acrylic polymers; and polyurethanes.

4. The composite fiber of claim 3 wherein said synthetic thermoplastic fiber-forming host polymer is poly(ethylene terephthalate).

5. The composite fiber of claim 1 wherein said compatibilizer is poly(butylene terephthalate).

6. The composite fiber of claim 5 wherein said synthetic thermoplastic fiber-forming host polymer is selected from the group consisting of:

polyamides;

polyesters;

polyvinyls;

polyolefins;

acrylic polymers; and polyurethanes.

7. The composite fiber of claim 6 wherein said synthetic thermoplastic fiber-forming host polymer is poly(ethylene terephthalate).

* * * * *